US012134848B2

(12) United States Patent
Jang et al.

(10) Patent No.: US 12,134,848 B2
(45) Date of Patent: Nov. 5, 2024

(54) ANHYDROUS FIBER-DYEING APPARATUS AND METHOD USING VACUUM TRANSFER, AND FIBER MANUFACTURED BY DYEING METHOD

(71) Applicant: ASSEMS INC., Busan (KR)

(72) Inventors: Ji-Sang Jang, Busan (KR); Jae-Jeong Lee, Busan (KR); Kyoung Kyu Kim, Busan (KR); Kyung-Seok Choi, Busan (KR); Chi-Kyun Park, Busan (KR); Yong-Hoon Park, Gimhae-si (KR)

(73) Assignee: ASSEMS INC., Busan (KR)

( * ) Notice: Subject to any disclaimer, the term of this patent is extended or adjusted under 35 U.S.C. 154(b) by 332 days.

(21) Appl. No.: 17/776,089

(22) PCT Filed: Nov. 12, 2020

(86) PCT No.: PCT/KR2020/015868

§ 371 (c)(1),
(2) Date: May 11, 2022

(87) PCT Pub. No.: WO2021/096240

PCT Pub. Date: May 20, 2021

(65) Prior Publication Data

US 2022/0396905 A1 Dec. 15, 2022

(30) Foreign Application Priority Data

Nov. 14, 2019 (KR) ..... 10-2019-0145792

(51) Int. Cl.
*D06B 11/00* (2006.01)
*D06B 3/04* (2006.01)
(Continued)

(52) U.S. Cl.
CPC ..... *D06B 11/0076* (2013.01); *D06B 3/04* (2013.01); *D06B 19/0058* (2013.01); *D06B 23/00* (2013.01); *D06P 5/003* (2013.01)

(58) Field of Classification Search
CPC .. D06B 11/0076; D06B 3/04; D06B 19/0058; D06B 23/00; D06B 5/003
(Continued)

(56) References Cited

FOREIGN PATENT DOCUMENTS

JP H11-061658 A 3/1999
JP 2001-329474 A 11/2001
(Continued)

OTHER PUBLICATIONS

International Search Report for PCT/KR2020/015868 mailed Mar. 25, 2021 from Korean Intellectual Property Office.
(Continued)

*Primary Examiner* — Eisa B Elhilo
(74) *Attorney, Agent, or Firm* — Paratus Law Group, PLLC

(57) ABSTRACT

An anhydrous fiber-dyeing apparatus using vacuum transfer, includes: a hollow drum in which a plurality of fine holes are formed to penetrate therethrough, and a fiber to be dyed are wound around an outer surface thereof; a transfer film covering the outer surface of the fiber wound around the drum and having an inner side surface coated with a dye; heating means heating the fiber wound around the drum; and a vacuum means suctioning air through an inner space of the drum to form a vacuum pressure through the fine holes of the drum.

17 Claims, 7 Drawing Sheets

(51) Int. Cl.
*D06B 19/00* (2006.01)
*D06B 23/00* (2006.01)
*D06P 5/24* (2006.01)

(58) Field of Classification Search
USPC ..... 8/467
See application file for complete search history.

(56) References Cited

FOREIGN PATENT DOCUMENTS

| | | | | | |
|---|---|---|---|---|---|
| JP | 2003-326697 | A | | 11/2003 | |
| JP | 2016108697 | A | * | 6/2016 | ..... D06P 5/00 |
| KR | 20-0230442 | Y1 | | 7/2001 | |
| KR | 10-2001-0111445 | A | | 12/2001 | |
| KR | 20-0334356 | Y1 | | 11/2003 | |
| KR | 10-0601923 | B1 | | 7/2006 | |
| KR | 10-0993062 | B1 | | 11/2010 | |
| KR | 10-2014-0066429 | A | | 6/2014 | |
| KR | 10-2017-0035306 | A | | 3/2017 | |
| WO | WO 2022/075590 | A1 | | 4/2022 | |

OTHER PUBLICATIONS

Chinese Office Action for related CN Application No. 202080079689.5 mailed Aug. 24, 2023 from China National Intellectual Property Administration.
European Search Report for related EP Application No. 20888440.3 mailed Oct. 25, 2023 from European Patent Office.
Korean Office Action for related KR Application No. 10-2019-0145792 mailed Jul. 5, 2024 from Korean Intellectual Property Office.

* cited by examiner

ANHYDROUS FIBER-DYEING APPARATUS AND METHOD USING VACUUM TRANSFER, AND FIBER MANUFACTURED BY DYEING METHOD

CROSS-REFERENCE TO PRIOR APPLICATIONS

This application is a National Stage Patent Application of PCT International Patent Application No. PCT/KR2020/015868 (filed on Nov. 12, 2020) under 35 U.S.C. § 371, which claims priority to Korean Patent Application No. 10-2019-0145792 (filed on Nov. 14, 2019), which are all hereby incorporated by reference in their entirety.

BACKGROUND

The disclosure relates to an apparatus and method for dyeing a fiber in a desired color, and more particularly, to an anhydrous fiber-dyeing apparatus and method using vacuum transfer by winding a fiber around a drum on which a plurality of fine holes are formed, covering the fiber with a transfer film coated with a dye of a color to be dyed, and then applying a high temperature in a vacuum chamber and, simultaneously, applying vacuum pressure in the drum so as to transfer the dye, having been coated on the transfer film, to the fiber, and dye the fiber, and a fiber manufactured by the dyeing method.

In general, in order to express various patterns or colors on fabric, a method of manufacturing fabric using different colored threads for warp and weft has been used. In the method of manufacturing fabric, as a pattern or color of the fabric is standardized, the pattern or color may not be variously changed. In order to obtain a unique image of a pattern or color, there is a problem in that a lot of production cost increases because it goes through several stages of preparation process.

In addition, there is a problem in that, in order to partially dye a fiber, since a plurality of dyeing tanks are required and the fiber should go through several stages of winding process, many devices are required and their installation costs cause an increase in production cost, and several winding processes are not only very cumbersome, but also the dyeing in irregular shapes does not work well.

In order to solve this problem, Korea Utility Model Registration No. 20-0334356 discloses a multicolor dyeing apparatus capable of providing a fiber with various colors by spraying pigment to an outer diameter portion of the fiber wound around a bobbin, and vacuum-suctioning the pigment so that the sprayed pigment may be uniformly absorbed up to an inner diameter portion of the fiber.

However, since the conventional dyeing apparatus including the registered utility model uses a method of spraying or dipping a liquid mixed with dye, a large amount of pollutants and a lot of wastewater are generated during a dyeing process, and therefore, it takes a lot of time and money to purify pollutants, which lowers economic efficiency, and but also it is difficult to completely purify the pollutants, which adversely affects the environment.

SUMMARY

The present disclosure provides an eco-friendly anhydrous fiber-dyeing apparatus and method capable of improving economic efficiency and workability by allowing a fiber to be easily dyed with one or more colors by a heating and vacuum method without using water, and a fiber manufactured by the dyeing method.

According to an aspect of the present invention, an anhydrous fiber-dyeing apparatus using vacuum transfer may include: a hollow drum in which a plurality of fine holes are formed to penetrate therethrough and a fiber to be dyed is wound around an outer surface thereof; a transfer film covering the outer surface of the fiber wound around the drum and having an inner side surface coated with a dye; heating means heating the fiber wound around the drum; and a vacuum means suctioning air through an inner space of the drum to form a vacuum pressure through the fine holes of the drum.

The heating means may include a heating chamber into which the drum on which the fiber and the transfer film are mounted is put and a hot air supply unit supplying hot air into the heating chamber. The anhydrous fiber-dyeing apparatus may further include an electric heater installed on an inner peripheral surface of the drum to apply heat to the fiber through the drum.

The heating means may include an electric heater installed on the inner peripheral surface of the drum to apply heat to the fiber through the drum.

The anhydrous fiber-dyeing apparatus may further include a sealing sheet sealing both end portions or the entirety of the transfer film to the drum in a state in which the transfer film is covered on the outer surface of the fiber.

The fiber wound around the drum may be wound in a straight line.

The fiber may be wound around the drum while crossing each other in a zigzag shape.

The drum may be formed in a mesh.

The dye coated on to the inner side surface of the transfer film may be arranged in at least two colors.

An anhydrous fiber dyeing method using vacuum transfer may include:

(S1) winding a fiber on an outer surface of a drum;

(S2) covering, with a dye-coated transfer film, an outer surface of the fiber wound around the drum;

(S3) heating the fiber by applying heat in a state in which the fiber and the transfer film are loaded on the drum; and (S4) suctioning air through the inner space of the drum to form vacuum pressure through fine holes of the drum.

The anhydrous fiber dyeing method of claim 10, wherein in step (S2), after a carrier film is covered on the outer surface of the fiber, both end portions or the entirety of the transfer film are sealed against the drum with a sealing sheet.

The step (S3) may include putting the drum into the heating chamber and supplying hot air into the heating chamber. In the step (S3), heat may be applied to the fiber through the drum by operating an electric heater installed on an inner peripheral surface of the drum.

In the step (S3), heat may be applied to the fiber through the drum by operating an electric heater installed on the inner peripheral surface of the drum.

In step (S1), the fiber may be wound around the drum in a straight line.

In step (S1), the fiber may be wound around the drum while crossing each other in a zigzag shape.

There is provided an anhydrous dyeing fiber body using vacuum transfer in which the same color is transferred in a cross-sectional direction of the fiber and different colors are transferred in each section along a longitudinal direction of the fiber.

According to the present disclosure, it is possible to very quickly an easily perform a dyeing process by transferring a dye coated on a transfer film to a fiber by a heating and vacuum method without using water or liquid, and obtain to obtain economical and eco-friendly advantages since there is no need to purify the liquid.

DETAILED DESCRIPTION

Figure 1:
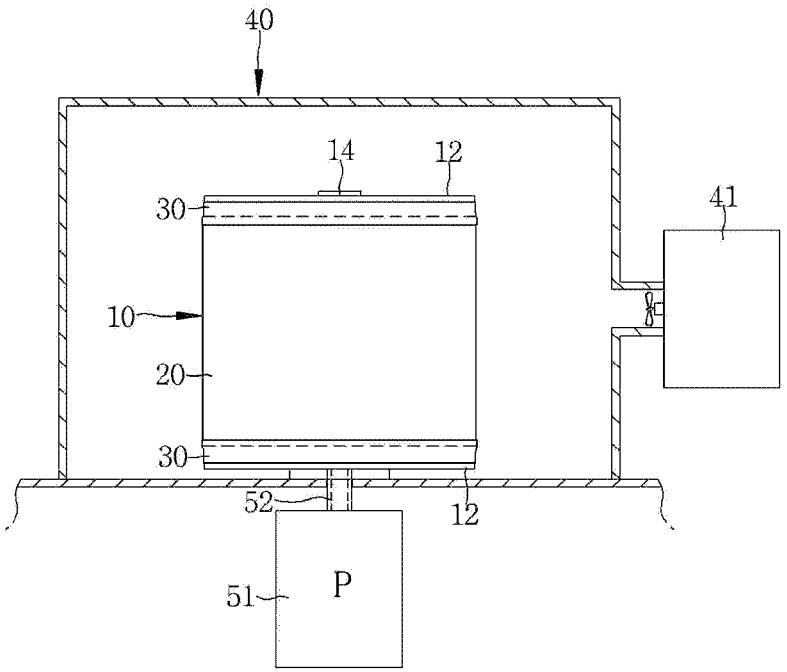
FIG. 1 is a cross-sectional view illustrating an anhydrous fiber-dyeing apparatus according to an embodiment of the present disclosure.
Figure 2:
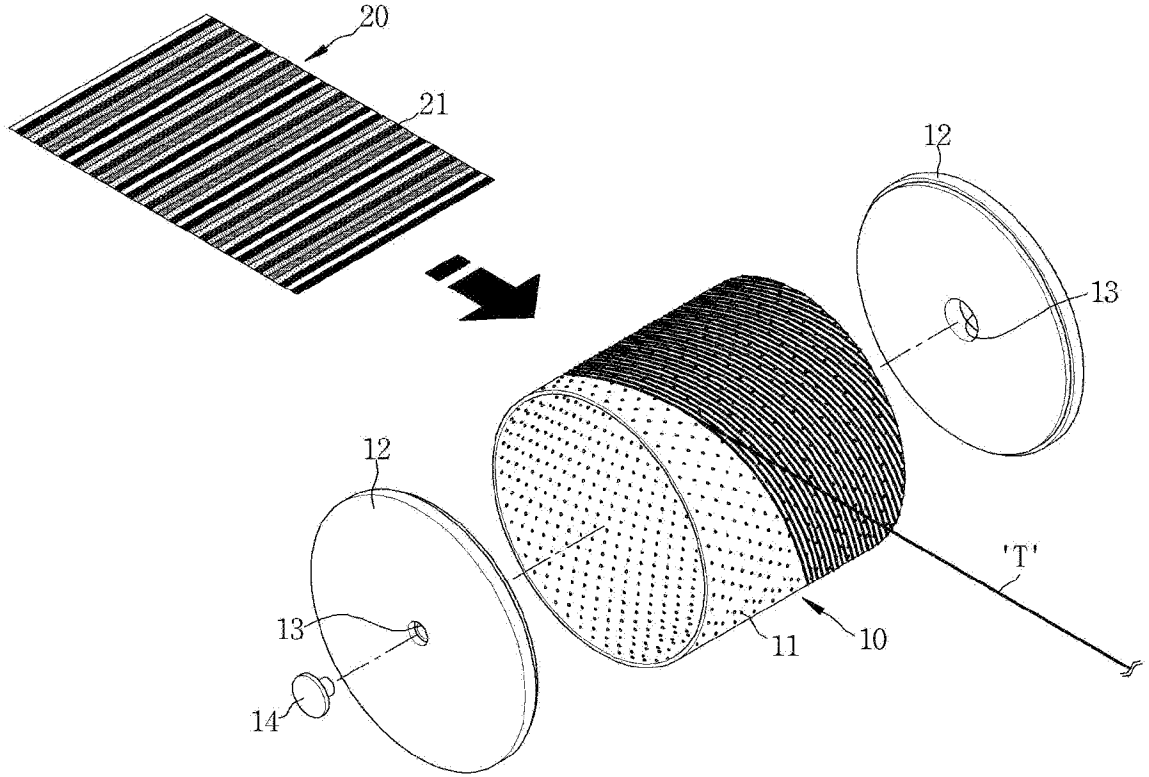
FIG. 2 is an exploded perspective view of a main configuration of the anhydrous fiber-dyeing apparatus illustrated in FIG. 1.
Figure 3:
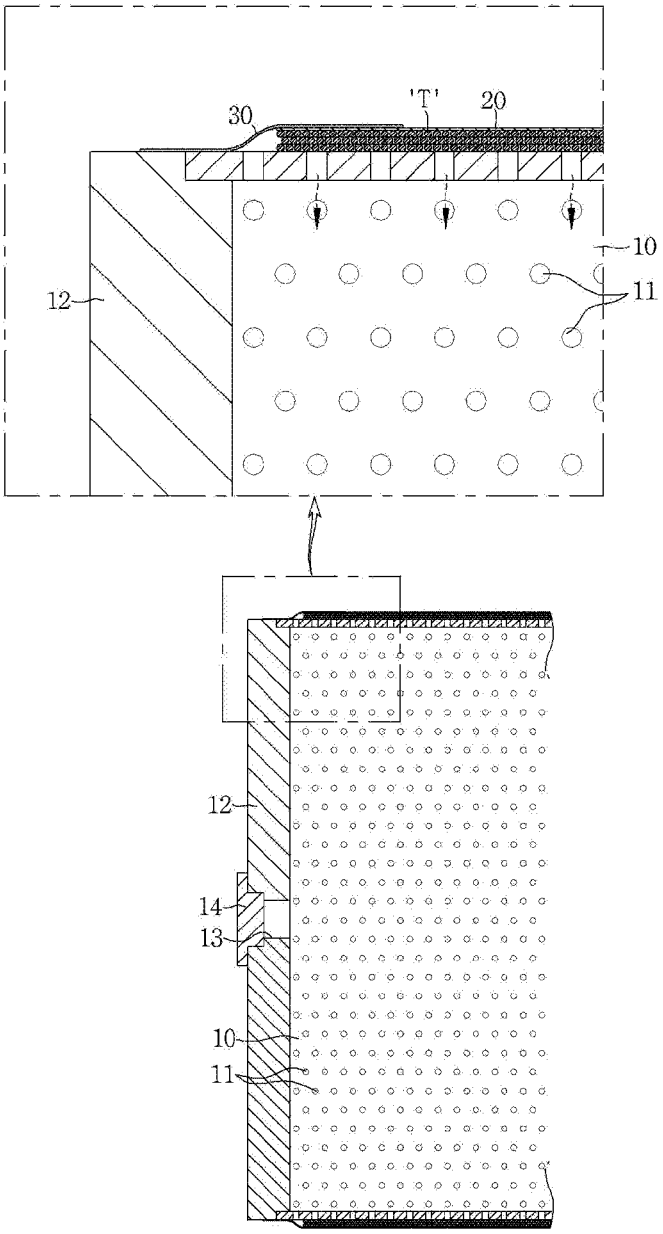
FIG. 3 is a sectional view of a major part of the anhydrous fiber-dyeing apparatus illustrated in FIG. 1.

Embodiments described in the present disclosure and the configurations illustrated in the drawings are only preferred examples of the disclosed invention, and there may be various modifications that may replace the embodiments and drawings of the present disclosure at the time of filing of the present application.

Hereinafter, an anhydrous fiber-dyeing apparatus and method and a fiber manufactured by a dyeing method using vacuum transfer according to the present disclosure will be described in detail according to embodiments described below with reference to the accompanying drawings.

Referring to FIGS. 1 to 5, the anhydrous fiber-dyeing apparatus according to an embodiment of the present disclosure includes a hollow drum 10 in which a plurality of fine holes 11 are formed to penetrate therethrough and a fiber T to be dyed is wound around an outer surface thereof, a transfer film 20 covering the outer surface of the fiber T wound around the drum 10 and having an inner side surface coated with a dye 21, heating means heating the fiber T wound around the drum 10; and a vacuum means suctioning air through an inner space of the drum 10 to form a vacuum pressure through the fine holes 11 of the drum 10.

The drum 10 is formed in a hollow cylindrical body, and the plurality of fine holes 11 communicating with the inner space of the drum 10 are formed to penetrate therethrough. The fine holes 11 are to form vacuum pressure while external air is suctioned into the inner space of the drum 10, and may be arranged on a side surface of the drum 10 in a grid form or a zigzag form. In this embodiment, the drum 10 may be formed in a cylindrical body through which the plurality of fine holes 11 penetrate, but differently, the drum 10 may be configured as the cylindrical body formed in the mesh to form the vacuum pressure through a mesh hole.

Meanwhile, both openings of the drum 10 are closed by two drum covers 12, and a central portion of each drum cover 12 is connected to a rotation shaft of a winder (not illustrated) for winding the fiber T or a connection port 13 connected to the vacuum means is formed to be open.

The fiber T may be a white fiber in an undyed state, and may be continuously wound in a generally straight shape when the fiber T is wound around an outer surface of the drum 10. However, when the amount of winding of the fiber T increases or a thickness of the fiber itself becomes thick, since it may be difficult to form the vacuum pressure, it is preferable that a fine gap may be formed between the fibers T by winding the fiber T on the drum while the fiber T crossing each other in a zigzag shape. The fiber T may be wound on the outer surface of the drum 10 in a separate winder.

The transfer film 20 covers the outer surface of the fiber wound around the drum 10. A dye 21 of a predetermined color made of a water-soluble ink to be transferred to the fiber T is applied to an inner side surface that comes into contact with the fiber T. The dye 21 may be formed of only one color, but the dye 21 in the form of a band of at least two colors may be continuously arranged in a longitudinal direction (which becomes a circumferential direction when wound around a drum). Of course, unlike this, the dye 21 may be applied to the surface of the transfer film 20 in any other form other than the form of the band. For example, when it is desired to dye a color in a circular or oval pattern over the entire fiber (T) wound around the drum 10, the dye 21 may be coated on the transfer film 20 in a circular or oval pattern. That is, the dye 21 may be formed on the surface of the transfer film 20 in the form to be transferred to the fiber T.

A length of the transfer film 20 may have a length slightly longer than a circumference of the drum 10, and a width thereof may have a length slightly smaller than that of the drum 10 so that the transfer film 20 may cover the outer surface of the fiber T wound around the drum 10 in general conformity. Therefore, after the transfer film 20 is covered on the outer surface of the fiber T, the fine holes 11 disposed on both end portions of the drum 10 may remain an opened state. In this case, when air is suctioned by the vacuum means, air is suctioned through the fine holes 11 opened to the outside, and the vacuum pressure may not be properly formed through the fine holes 11 covered by the fiber T. Therefore, it is preferable to seal the drum 10 by covering both end portions of the transfer film 20 or the entirety of the transfer film 20 with a sealing sheet 30 made of a resin material such as silicone.

The heating means is to expand a space between molecular structures of the fiber T wound around the drum 10 so that the dye 21 of the transfer film 20 may easily penetrate. In this embodiment, the heating means includes a heating chamber 40 into which the drum 10 on which the fiber T and the transfer film 20 are mounted is put, and a hot air supply unit 41 for supplying hot air into the heating chamber 40.

The hot air supply unit 41 is configured to uniformly blow air heated by the heater into the heating chamber 40, and may be configured by applying the known hot air device configured to supply hot air into the chamber.

Figure 6:
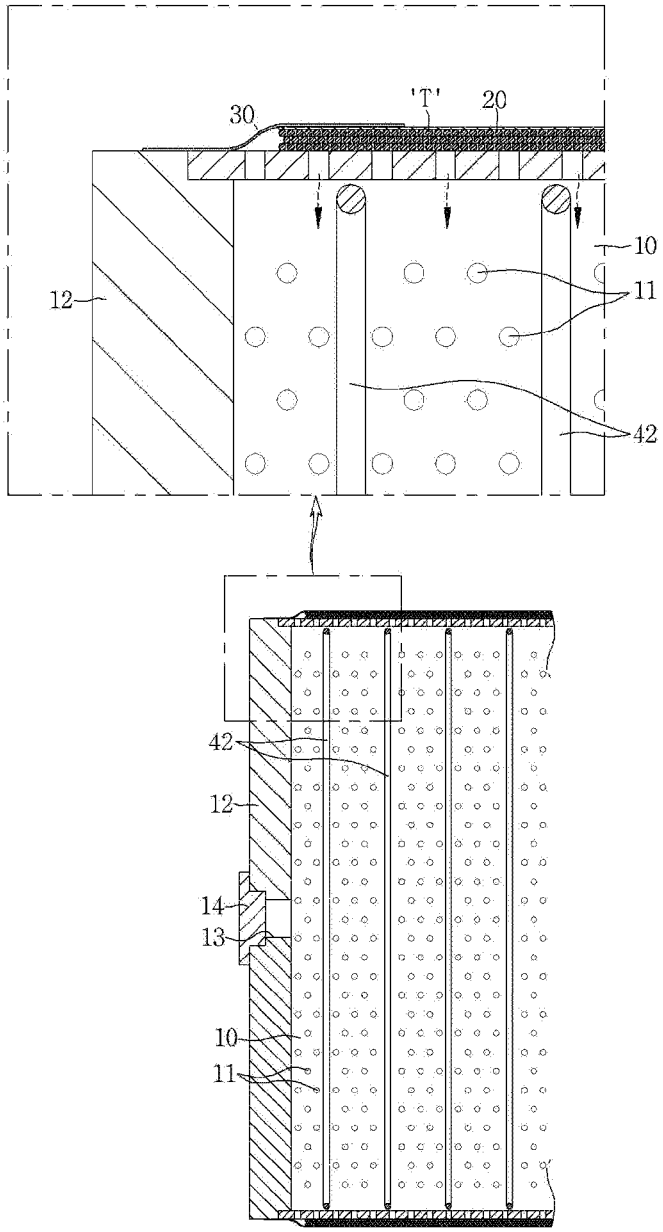
FIG. 6 is a cross-sectional view illustrating a main part of an anhydrous fiber-dyeing apparatus according to another embodiment of the present disclosure.

In addition, in order to apply heat to the fiber T from the inside of the drum 10, an electric heater 42 is installed on the inner peripheral surface of the drum 10 as illustrated in FIG. 6 to transfer heat to the fiber T through the drum 10. Of course, heat may be applied to the fiber (T) only by the electric heater 42 without putting the drum 10 into the heating chamber 40. That is, only the electric heater 42 may be configured as the heating means.

The vacuum means acts as to apply an external force so that particles of the dye 21 of the transfer film 20 may smoothly penetrate between molecular spaces of the fiber T to be dyed in a state in which the space between the molecular structure of the fiber T is expanded due to the activation of the fiber T and dye by the heating means.

This vacuum means may be configured together with the heating chamber 40. For example, the vacuum means includes a vacuum pump 51 that is installed outside the heating chamber 40 to suctioning air, and an intake passage 52 that penetrates through one surface (lower surface in this embodiment) of the heating chamber 40 to connect the vacuum pump 51 and the connection port 13 of the drum cover 12 installed on one end portion of the drum 10. A gasket member (not illustrated) made of rubber or silicone to prevent leakage of air may be installed at the end portion of the intake passage 52 connected to the connection port 13 of the drum cover 12.

Therefore, when the vacuum pump 51 operates and a suction force is generated through the intake passage 52, as air in the inner space of the drum 10 is suctioned into the vacuum pump 51, and at the same time, is suctioned through the fine holes 11 of the drum 10, the vacuum pressure is formed so that the transfer of the dye 21 of the transfer film 20 is possible.

The anhydrous fiber dyeing method using such an anhydrous fiber-dyeing apparatus will be described in detail with reference to FIGS. 4A to 4E as follows.

Figure 4A:
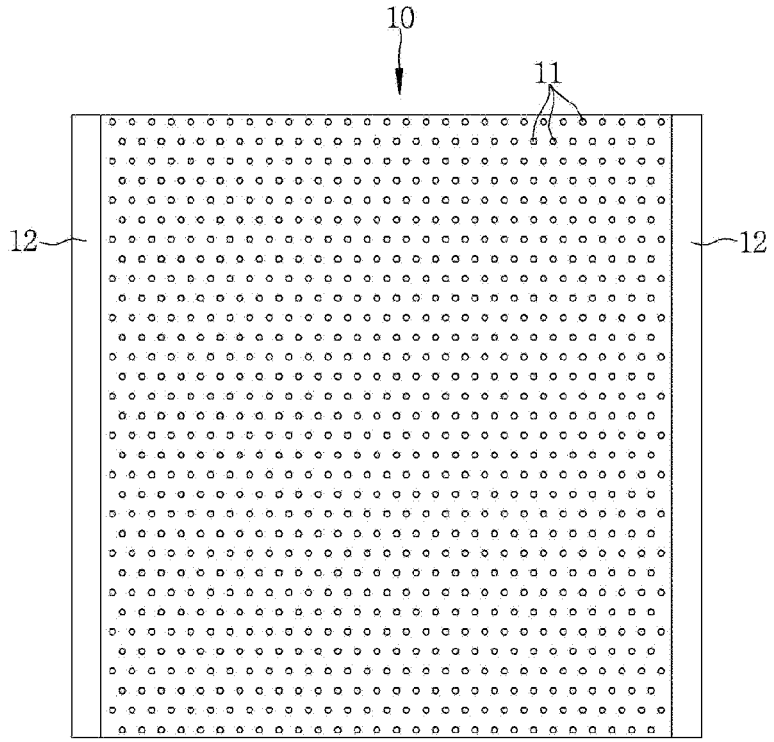
FIGS. 4A to 4E are diagrams sequentially illustrating an anhydrous fiber dyeing method according to an embodiment of the present disclosure.
Figure 4B:
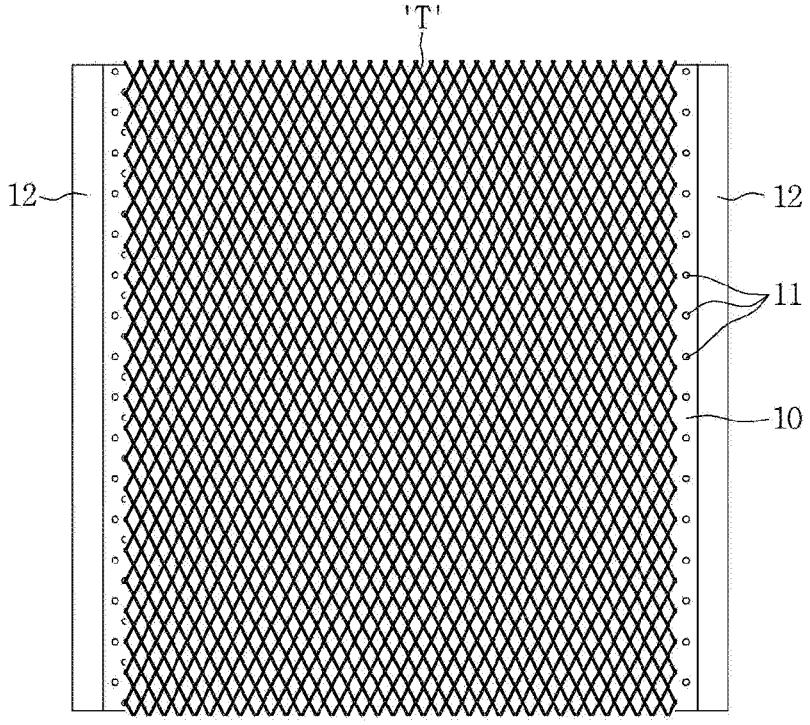

First, as illustrated in FIG. 4A, the drum cover 12 is installed on both end portions of the drum 10, and the drum 10 is mounted on a winder to wind the fiber T on the outer surface of the drum 10 (see FIG. 4B). In this case, as described above, the fiber T may be wound continuously in a generally straight shape, but may be wound while crossing each other in a zigzag shape to smoothly generate the vacuum pressure by suctioning air through the fine holes 11 of the drum 10.

Figure 4C:
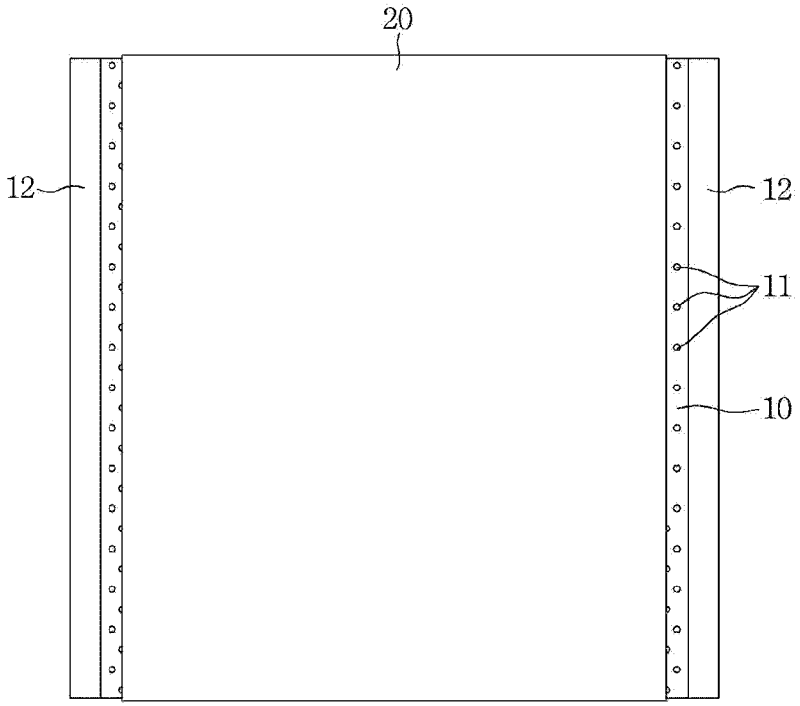
Figure 4D:
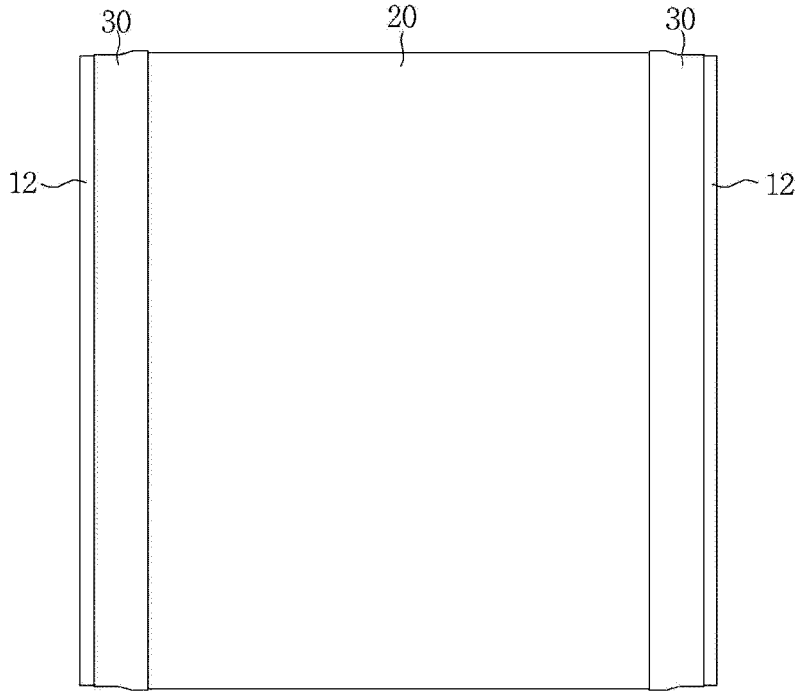
Figure 4E:
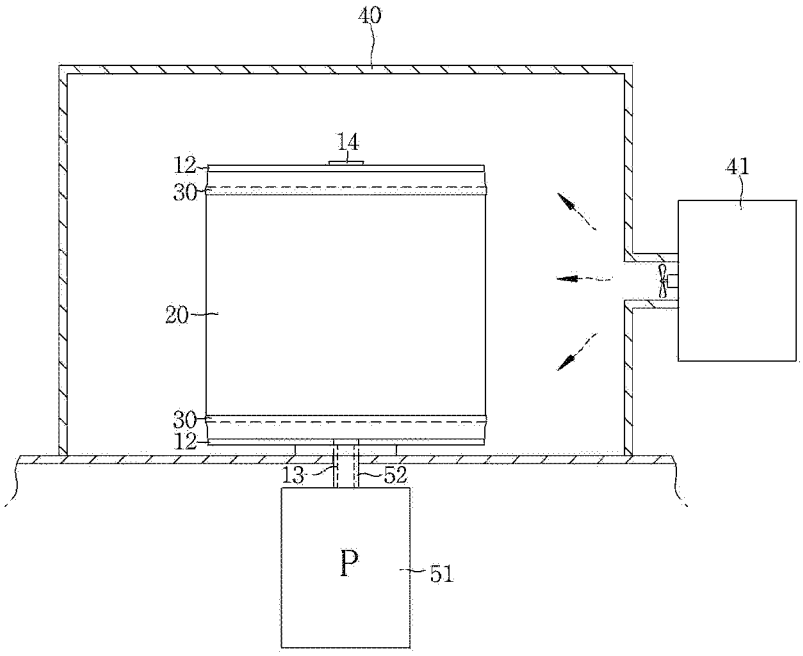

When all the fiber T is wound on the outer surface of the drum 10, the transfer film 20 coated with the dye 21 is covered on the outer surface of the fiber T as illustrated in FIG. 4C. As illustrated in FIG. 4D, both end portions or the entirety of the transfer film 20 are covered with the sealing sheet 30 to seal the both end portions or the entirety of the transfer film 20 with respect to the drum 10.

Then, as described above, after the drum 10 on which the fiber T, the transfer film 20, and the sealing sheet 30 are mounted is put into the heating chamber 40, the connection port 13 of the drum cover 12 on one side of the drum 10 is connected to the intake passage 52 connected to the vacuum pump 51, and the connection port 13 of the drum cover 12 on the opposite side of the drum 10 is completely closed with a stopper or packing material 14.

When the dyeing preparation process is completed, the hot air supply unit 41 operates to supply hot air to the inside of the heating chamber 40, thereby heating the fiber T. In this case, when the electric heater 42 is provided inside the drum 10, the electric heater 42 may also operate to apply heat to the fiber T through the drum 10.

When the fiber T is heated in this way, the space between the molecular structures of the fiber T expands, making it easier for the particles of the dye 21 to permeate.

In this case, when the vacuum pump 51 operates, the air inside the drum 10 is suctioned into the vacuum pump 51 through the intake passage 52, and at the same time, a force by which air is suctioned through the fine holes 11 of the drum 10 acts to generate the vacuum pressure. As a result, the dye 21 of the transfer film 20 is easily transferred into the space between the molecular structures of the expanded fiber T, so the dyeing may be uniformly made from the outer fiber T wound around the drum 10 to the inner fiber T.

Figure 5:
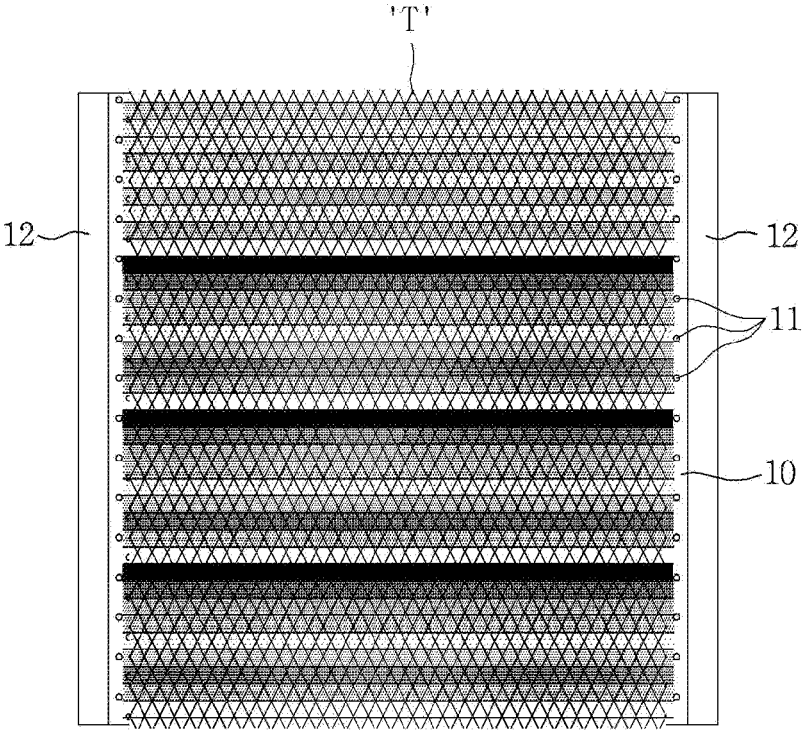
FIG. 5 is a diagram illustrating an embodiment of a fiber body formed of a fiber dyed by the dry fiber dyeing method according to the present disclosure.

FIG. 5 illustrates the fiber body in a state in which various colors are continuously dyed in the form of the band on the fiber T through the above-described method.

That is, the existing fiber in which various colors are mixed are illustrated in the form in which various colors are mixed by twisting fibers having different colors, but in the fiber body manufactured by the dry dyeing method using the vacuum transfer according to the preferred embodiment of the present disclosure, the same color is transferred in the cross-sectional direction of the fiber, and different colors are transferred for each section along the longitudinal direction of the fiber. In the case of the existing braided yarn, the thickness of the fiber is too thick, so the braided yarn is not suitable for use as a sewing thread or embroidery thread.

Therefore, it has the effect of forming high-quality products such as company logos by displaying fibers that show a clearer color than the existing fibers, and it is applicable to the sewing thread, the embroidery thread, the decoration thread, and DTY (filament twisted by processing the surface of the thread).

As described above, according to the present disclosure, it is possible to very quickly an easily perform a dyeing process by transferring the dye 21 coated on the transfer film 20 to the fiber T by a heating and vacuum method without using water or liquid, and obtain to obtain the economical and eco-friendly advantages since there is no need to purify the liquid.

Hereinabove, the present disclosure has been described in detail with reference to the embodiments, but those of ordinary skill in the art to which the present disclosure pertains may perform various substitutions, additions and modifications without departing from the technical idea described above. It should be understood that such modified embodiments also fall within the scope of protection of the present disclosure as defined by the appended claims below.

The present disclosure is applicable to the fiber-dyeing apparatus for dyeing a fiber.

The invention claimed is:

1. An anhydrous fiber-dyeing apparatus using vacuum transfer, comprising:

a hollow drum in which a plurality of fine holes are formed to penetrate therethrough, and a fiber to be dyed are wound around an outer surface thereof;

a transfer film covering the outer surface of the fiber wound around the drum and having an inner side surface coated with a dye;

heating means heating the fiber wound around the drum;

a vacuum means suctioning air through an inner space of the drum to form a vacuum pressure through the fine holes of the drum; and a sealing sheet sealing both end portions or the entirety of the transfer film to the drum in a state in which the transfer film is covered on the outer surface of the fiber.

2. The anhydrous fiber-dyeing apparatus of claim 1, wherein the heating means include a heating chamber into which the drum on which the fiber and the transfer film are mounted is put and a hot air supply unit supplying hot air into the heating chamber.

3. The anhydrous fiber-dyeing apparatus of claim 2, further comprising: an electric heater installed on an inner peripheral surface of the drum to apply heat to the fiber through the drum.

4. The anhydrous fiber-dyeing apparatus of claim 1, wherein the heating means includes an electric heater installed on the inner peripheral surface of the drum to apply heat to the fiber through the drum.

5. The anhydrous fiber-dyeing apparatus of claim 1, wherein the fiber wound around the drum is wound in a straight line.

6. The anhydrous fiber-dyeing apparatus of claim 1, wherein the fiber is wound around the drum while crossing each other in a zigzag shape.

7. The anhydrous fiber-dyeing apparatus of claim 1, wherein the drum is formed in a mesh.

8. The anhydrous fiber-dyeing apparatus of claim 1, wherein the dye coated on the inner side surface of the transfer film is arranged in at least two colors.

9. An anhydrous fiber dyeing method using vacuum transfer, comprising:

(S1) winding a fiber on an outer surface of a drum;

(S2) covering, with a dye-coated transfer film, an outer surface of the fiber wound around the drum;

(S3) heating the fiber by applying heat in a state in which the fiber and the transfer film are loaded on the drum; and (S4) suctioning air through the inner space of the drum to form vacuum pressure through fine holes of the drum, wherein in step (S2), after a carrier film is covered on the outer surface of the fiber, both end portions or the entirety of the transfer film are sealed against the drum with a sealing sheet.

10. The anhydrous fiber dyeing method of claim 9, wherein the step (S3) includes putting the drum into the heating chamber and supplying hot air into the heating chamber.

11. The anhydrous fiber dyeing method of claim 10, wherein, in the step (S3), heat is applied to the fiber through the drum by operating an electric heater installed on an inner peripheral surface of the drum.

12. The anhydrous fiber dyeing method of claim 9, wherein, in the step (S3), heat is applied to the fiber through the drum by operating an electric heater installed on an inner peripheral surface of the drum.

13. The anhydrous fiber dyeing method of claim 9, wherein, in step (S1), the fiber is wound around the drum in a straight line.

14. The anhydrous fiber dyeing method of claim 9, wherein, in step (S1), the fiber is wound around the drum while crossing each other in a zigzag shape.

15. A fiber dyed using the fiber dyeing method according to claim 10.

16. The fiber of claim 15, wherein at least two or more colors are arranged.

17. An anhydrous dyeing fiber body using vacuum transfer in which the same color is transferred in a cross-sectional direction of the fiber and different colors are transferred in each section along a longitudinal direction of the fiber.

* * * * *